US005713093A

United States Patent [19]

Enz

[11] Patent Number: 5,713,093

[45] Date of Patent: Feb. 3, 1998

[54] PIPE-CLEANING DEVICE WITH CUTTING HEAD

[75] Inventor: Albert Enz, Giswil, Switzerland

[73] Assignee: Enz Technik AG, Giswil, Switzerland

[21] Appl. No.: 644,647

[22] Filed: May 7, 1996

[51] Int. Cl.[6] ..... B08B 9/02

[52] U.S. Cl. ..... 15/104.12; 15/104.31

[58] Field of Search ..... 15/104.05, 104.09, 15/104.07, 104.12, 104.31

[56] References Cited

U.S. PATENT DOCUMENTS

| | | | |
|---|---|---|---|
| 595,971 | 12/1897 | Rothenbücher | 15/104.31 X |
| 1,036,735 | 8/1912 | Sieben et al. | 15/104.31 X |
| 1,132,690 | 3/1915 | Sieben | 15/104.31 X |
| 1,132,691 | 3/1915 | Sieben | 15/104.31 X |
| 1,163,624 | 12/1915 | Stevenson et al. | 15/104.31 X |
| 1,498,446 | 6/1924 | Geskey | 15/104.31 |
| 1,717,986 | 6/1929 | Liebau | 15/104.31 X |
| 2,062,850 | 12/1936 | Weaver et al. | 15/104.31 |
| 3,525,112 | 8/1970 | Masters | 15/104.31 X |

FOREIGN PATENT DOCUMENTS

| | | | |
|---|---|---|---|
| 0077562 | 4/1983 | European Pat. Off. . | |
| 2432168 | 2/1976 | Germany | 15/104.31 |
| 3427167 | 2/1986 | Germany | 15/104.05 |
| 322175 | 7/1951 | Switzerland | 15/104.12 |

*Primary Examiner*—Mark Spisich

*Attorney, Agent, or Firm*—Weingarten, Schurgin, Gagnebin & Hayes LLP

[57] ABSTRACT

A pipe-cleaning device with a cutting head (3) makes it possible to clean clogged pipelines completely, even those clogged with concrete, for example. The cutting head (3) works like a jack hammer as it rotates and is driven only by a pressurized medium, which also rinses the pipeline and carries off the debris. The cleaning device is moved forward automatically by hammer impulses produced by curved disks (12, 22), impulse compensation and the backflow of the pressurized medium in the pipeline, precisely according to its cutting capacity at the time. The cleaning device follows the course of the pipelines and cleans them without damaging them.

7 Claims, 2 Drawing Sheets

PIPE-CLEANING DEVICE WITH CUTTING HEAD

FIELD OF THE INVENTION

The invention concerns a pipe-cleaning device with a cutting head, a guide block, which can be adjusted to the inside diameter of the pipe and a central holding pipe with a feed pipe in it for a pressurized medium; a rotor is mounted on the front of the feed pipe so it can turn, and the rotor has recoil nozzles pointed radially to the rear.

BACKGROUND OF THE INVENTION

EP-B 0 077 562 describes a pipe-cleaning device for plumbing lines with a rotor that is mounted on one axis of a stator. The axle has a hole in the middle as a feed line for pressurized water. The pressurized water goes out of the stator through radial holes and flows into the rotor. Nozzles are arranged alternately radially and approximately tangentially on the periphery of the rotor. The nozzles arranged radially are used for rinsing, and the tangential nozzles set the rotor in rotation. The rotor either has a cutting head on the front or a cleaning tool on the side, for example a chain. Other nozzles are placed diagonally on the rotor toward the back. These nozzles should produce a jackhammer-type effect. One disadvantage of this invention is that this pipe-cleaning device does not fit perfectly into a pipeline. Especially in the embodiment with the cutting head, this pipe-cleaning device has a tendency when pushed in not to run along through the pipeline, but to go in and through the wall straight ahead or to sink down due to its own weight. Because of this, the pipeline to be cleaned is frequently damaged and its walls even broken through. Another disadvantage is that the rubbed-off parts, in the design with the cutting head, are scarcely carried off, and the cutting head remains stuck in the debris it has produced.

SUMMARY OF THE INVENTION

The task of the invention is to avoid the disadvantages mentioned above. It should produce a pipe-cleaning device with a cutting head that is highly effective, even for example with pipelines completely clogged with concrete, runs perfectly through the pipeline, unclogs it and cleans it out without damaging it.

This task is solved by the invention specified in the independent patent claim.

One advantage of the invention is that the cutting head acts like a percussion hammer on the clogged material as it rotates.

Another advantage of the invention is that the cleaning device is moved forward automatically by the hammering impulses, impulse compensation and backflow of the pressurized medium into the pipeline, precisely in accordance with its cutting capacity at the time. Water is suitable for the pressure medium. Depending on the purpose for which the pipeline being cleaned is being used, another liquid can also be used.

BRIEF DESCRIPTION OF THE DRAWINGS

The pipe-cleaning device in the invention will be described below along with the drawings.

DETAILED DESCRIPTION OF THE DRAWINGS

Figure 1:
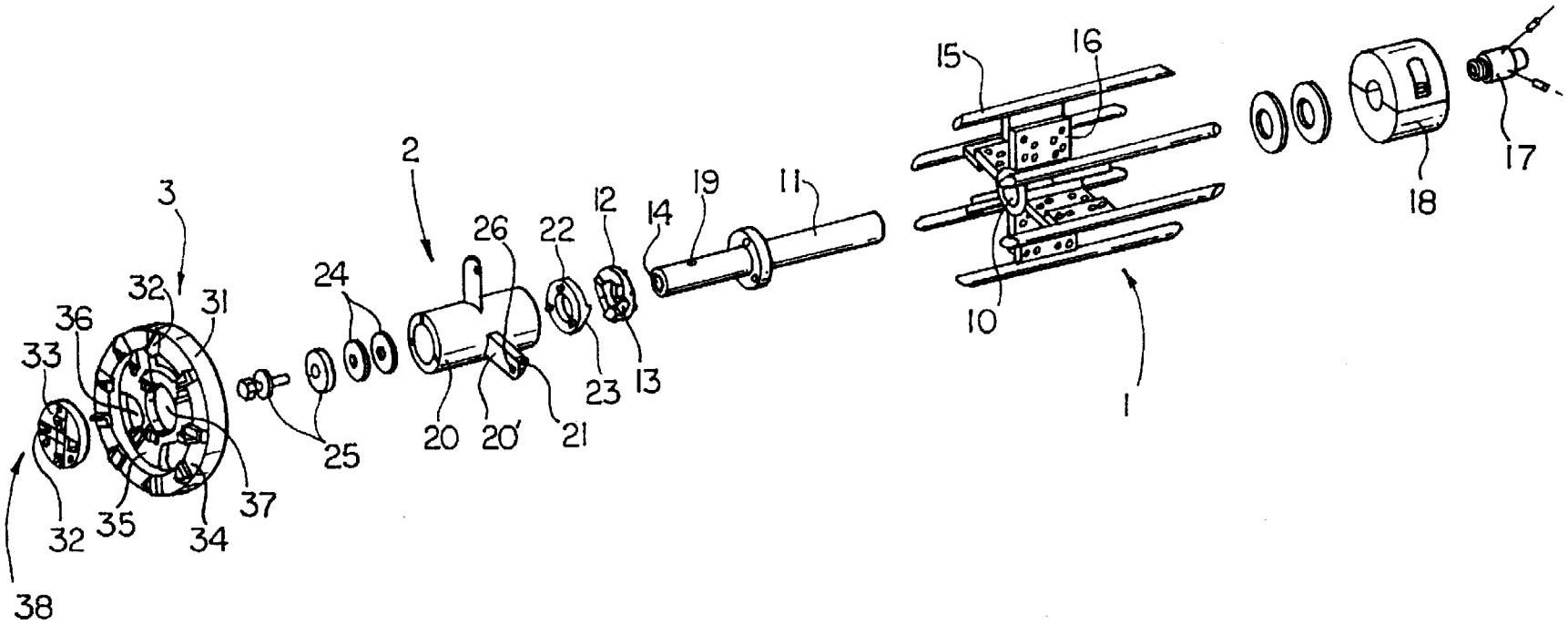
FIG. 1 shows an exploded drawing of the whole device.

The pipe-cleaning device in the invention to free clogged pipelines in FIG. 1 consists of a guide block 1, a rotor 2 and a cutting head 3. In the rest of the description, the cutting head or the side that points into the pipeline to be cleaned is marked as the front. The side from which the cleaning device is put into the pipeline is marked the back.

The guide block 1 consists of a central holding pipe 10. On this holding pipe 10, several adjustment plates 16 are placed radially and parallel to it. The holes are used to attach the guide runners 15 at adjustable intervals. Each guide runner 15 can also be equipped with wheels or rollers pointing radially to the outside. The guide block 1 takes the pipe-cleaning device into the pipeline to be cleaned by sliding it along the runners on the inner wall of the pipeline. The holding pipe 10 holds a feed pipe 11 on the inside. It is firmly connected to it, for example by means of a flange and screws. The feed pipe 11 is used to feed in a pressure medium, like water or the like, from the back. It is connected to a pump via a pipe or pipe coupling 17.

In back of the holding pipe 10, there is an equalizing weight 18 attached to it or to the feed pipe 11. The equalizing weight 18 absorbs the energy from the high impact and diverts it to the front.

On the front, the feed pipe 11 holds the rotor 2 as the central permanent shaft. On the front, it has a threaded hole 14 for a screw as a means of holding 25. Near the front end of the feed pipe 11 are holes 19 it. Through them, the pressurized medium is pumped into the area between the rotor 2 and the feed pipe 11 and are used to mount the rotor 2 without friction. From here, the pressurized medium flows on through recoil nozzles 21.

Figure 2:
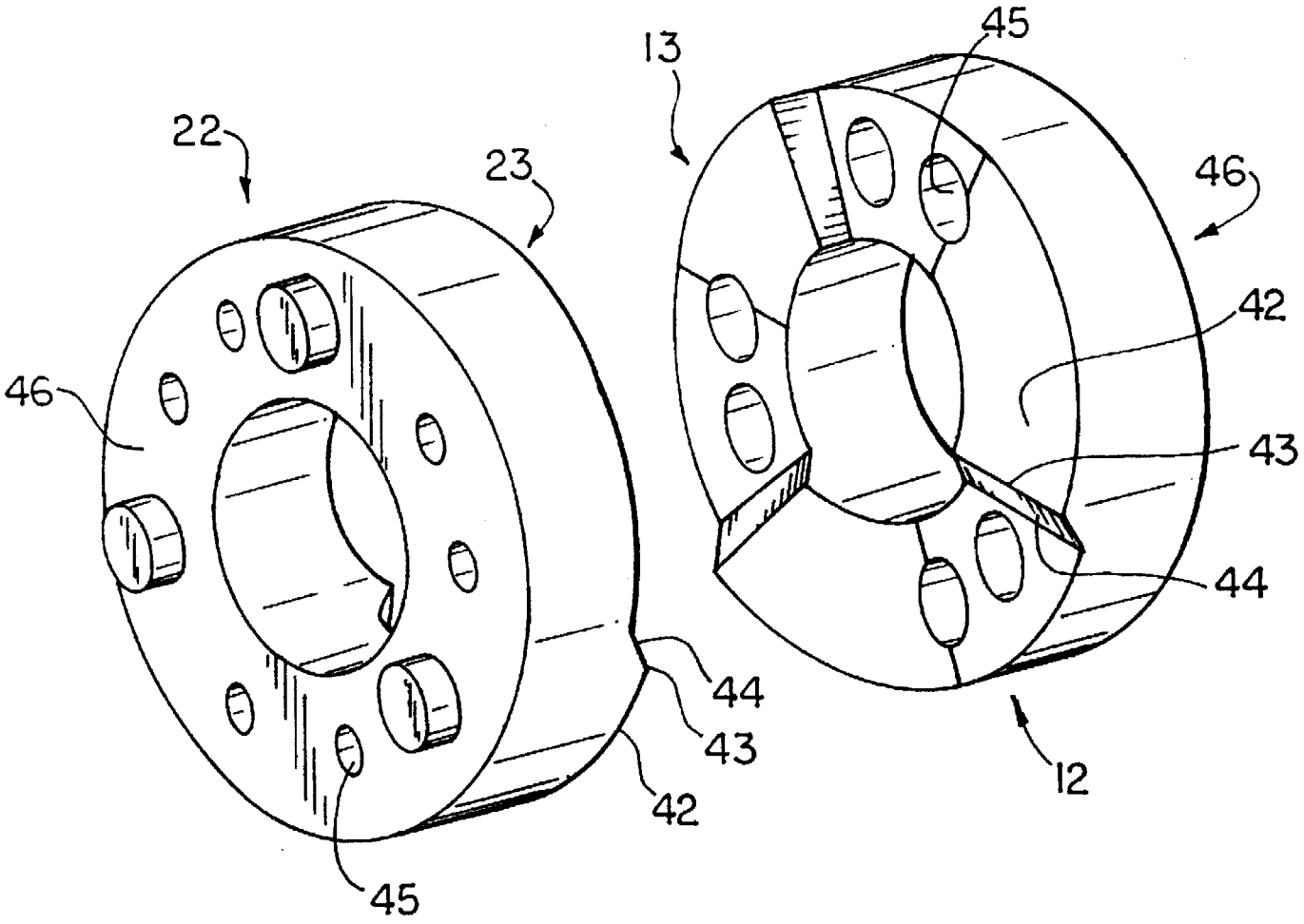
FIG. 2 shows a view of a curved disk.

Between the holding pipe 10 and the rotor is a second curved disk 12, with its curved round surface in the direction toward the rotor 2 mounted firmly to the feed pipe 11. The second curved disk 12 is a ring with a flat back and variable thickness. Its surface is curved in front. The second curved disk 12 is also shown in FIG. 2 like the first curved disk 22, which works with it, and will be described further below.

The rotor 2 consists of a tubular piece 20, which surrounds the feed pipe 11. It has several arms 20' arranged radially. Each arm 20' has a recoil nozzle 21 placed roughly tangentially to the rotor. A channel leads from the inside of the tubular piece 20 through the arm 20' to the recoil nozzle 21. The pressurized medium flows under pressure out of the space between the feed pipe 11 and the tubular piece 20 through the channel to the recoil nozzle 21, where it leaves the rotor 2 roughly tangentially and sets it in rotation.

The tubular piece 20 of the rotor 2 has a first curved disk 22 on the back, which points with its first curved supporting surface 23 backward toward the second curved disk 12. This first curved disk 22 corresponds to its embodiment of the second curved disk 12 and is described with it in greater detail below.

The rotor 2 is supported in front by spring elements 24 on the holder 25 and thus on the feed pipe 11. These spring elements 24 take the blows, as soon as the cutting head 3 meets no resistance. In this way, the hammering impulses push the whole cleaning device faster on into the pipeline to be cleaned.

The arms 20' of the rotor 2 also have threaded holes on the front. They are for screws with which the cutting head is attached to the arms.

The cutting head 3 consists of a plate-shaped holder 31, which has cutting elements 32 at suitable places. The cutting elements 32 are the known type of tooth-like elements made of hard metal or other suitable materials. They are attached to the holder 31 and can be detached. The holder 31 has an edge 34 in the form of embodiment shown and preferred that has cutting elements 32 at regular intervals in front. A holder base 35 recessed in relation to it has holes 36 and cutting elements 32. The holes 36 allow the pressurized medium to flow to the front of the cutting head and back. That way, the material that is constantly cut off the cutting head 3 is rinsed off backwards and the cutting elements 32 are simultaneously cooled.

The tubular piece 20 projects through a hole 37 in the middle of the front of the holder 31. The tubular piece 20 has threaded holes on the front to which a stocking cutter 38 is screwed. The stocking cutter 38 is designed as a circular disk as the holder 33 and also has cutting elements 32.

The first and second curved disks 12, 22 are designed alike and shown in FIG. 2. When mounted, they point toward one another with the curved supporting surfaces 13, 23. Since the first curved disk 22 is connected firmly to the rotor 2 and the second curved disk 12 to the feed pipe 11, they move opposite one another when the rotor 2 is rotating. In this way, with each run, the rotor 2 and hence the cutting head 3 are moved axially forward toward the front, with a mass and play determined by the curved disk, from 5 mm to 20 mm depending on the model, whereupon it [the rotor] slides back into the starting position. With each movement forward, it produces a hammer impulse on the cutting head 3. This sharply increases the cutting capacity, especially when cutting hard clogs out of the pipelines to be cleaned.

The curved disks 12, 22 are round and go around the feed pipe 11. Each has a flat mounting surface 46 and a curved surface 13, 23. Mounting holes 45 are made at regular intervals. The mounting holes 45 are used for screws to attach the curved disks 12, 22. The first curved disk 22 is screwed onto the rotor 2, and the second curved disk 12 onto the feed pipe 11. The curved surfaces 13, 23 follow regularly one after the other in the direction in which the rotor rotates. When seen from the front, they are divided into three equal sections staggered 120° apart. Each section consists of an ascending surface 42, a descending surface 44 and edges 43 corresponding to the change in curvature. The ascending surface 42, which is curved slightly forward, increases the thickness of the curved disks 12, 22. The descending surface 44 makes the thickness of the curved disks 12, 22 smaller and then in turn goes over into the next ascending surface 42 after it. At the transition between the ascending surfaces 42 and the adjacent descending surfaces 44, there is an edge 43. With each rotation, the rotor 2 is moved 360° three times by twice the difference between the minimum and maximum thickness of a curved disk 12, 22 forward in the direction of the front of the cleaning device and then pushed back again. Forward movement is produced by the curved disks. Backward movement is produced by the resistance that the cutting machine meets. Quickly rotating the cutter produces a fast series of movements forward which have the effect of fast repeated hammer impulses or blows. If the cutter 3 meets minimal resistance or none at all, the spring elements 24 absorb the hammer impulses and move the rotor back again. The equalization mass 18 absorbs a large part of the counter impulses acting on the back. That way, a forward force is always produced which drives the cleaning device automatically forward through the pipeline to be cleaned.

I claim:

1. A pipe-cleaning device comprising:

a cutting head (3);

a guide block (1) which can be adjusted to the inner diameter of the pipeline, said guide block including a central holding pipe (10) and further a feed pipe (11) in said central holding pipe for a pressurized medium; and a rotor (2) mounted on the front of the feed pipe so it can turn, wherein the rotor has recoil nozzles (21) pointing tangential to the rotor, characterized by the fact that the rotor (2) is connected on the front thereof to said cutting head, said cutting head including at least one holder (31) with cutting elements (32) and mounted on the feed pipe (11) so it can move, and the rotor (2) comprising a first curved disk (22) on the back, by means of which it is supported on a second curved disk (12) placed on the front of the holding pipe (10), wherein the first curved disk (22) has a first curved supporting surface (23), and the second curved disk (12) has a second curved supporting surface (13), wherein both curved supporting surfaces (13, 23) lie opposite one another, said curved disks creating a hammering impulse as the cutting head is rotated.

2. A pipe-cleaning device according to claim 1, characterized by the fact that the curved supporting surfaces (13, 23) of the curved disks (12, 22) have a slightly inclined ascending surface (42) and then a sharply falling descending surface (44) in the direction of rotation of the rotor (2).

3. A pipe-cleaning device according to claim 1, characterized by the fact that the rotor (2) is secured longitudinally on the front by means of holders (25) connected to the feed pipe (11) so they can be detached.

4. A pipe-cleaning device according to claim 3, characterized by the fact that spring elements (24) are arranged between the holding means (25) and the rotor (2).

5. A pipe-cleaning device according to claim 1, characterized by the fact that an equalizing weight (18) is attached to the back of the guide block (1) on at least one of the feed pipe (11) and the holding pipe (10).

6. A pipe-cleaning device according to claim 1 characterized by the fact that the cutting head (3) consists of several holders (31, 33) with cutting elements (32).

7. A pipe-cleaning device according to claim 6, characterized by the fact that one of said holders (31, 33) is designed as a stocking cutter (38).

* * * * *